US008329258B2

(12) United States Patent
Seitz

(10) Patent No.: US 8,329,258 B2
(45) Date of Patent: Dec. 11, 2012

(54) METHOD AND DEVICE FOR ELECTROSTATIC COATING OF AN ELECTRICALLY CONDUCTING WORKPIECE WITH COATING POWDER

(75) Inventor: Kurt Seitz, Widnau (CH)

(73) Assignee: J. Wagner AG, Altstatten (CH)

( * ) Notice: Subject to any disclaimer, the term of this patent is extended or adjusted under 35 U.S.C. 154(b) by 230 days.

(21) Appl. No.: 12/250,659

(22) Filed: Oct. 14, 2008

(65) Prior Publication Data

US 2009/0104368 A1 Apr. 23, 2009

(30) Foreign Application Priority Data

Oct. 17, 2007 (EP) ..... 07405310

(51) Int. Cl.
*B05D 1/04* (2006.01)
*B05D 1/06* (2006.01)

(52) U.S. Cl. ..... 427/469; 427/467; 427/475

(58) Field of Classification Search ..... 427/469, 427/467, 475
See application file for complete search history.

(56) References Cited

U.S. PATENT DOCUMENTS 3,698,636 A * 10/1972 Szasz ..... 239/697
3,930,614 A * 1/1976 Krenkel ..... 239/695
6,743,463 B2 * 6/2004 Weber et al. ..... 427/2.24
7,018,680 B2 * 3/2006 Kasma et al. ..... 427/471

FOREIGN PATENT DOCUMENTS

DE 42 19 621 12/1993
EP 0 260 853 3/1988

OTHER PUBLICATIONS

European Search Report for corresponding Application No. 07 40 5310.9 dated Feb. 29, 2008.

* cited by examiner

*Primary Examiner* — Frederick Parker
(74) *Attorney, Agent, or Firm* — Renner, Otto, Boisselle & Sklar, LLP

(57) ABSTRACT

The method according to the invention for electrostatic coating of an electrically conducting workpiece with coating powder includes the following steps. The workpiece is earthed. Then an electrode has a negatives potential applied to it compared to that of the workpiece and a counter-electrode has a positive potential applied to it compared to that of the workpiece. The potential in the area of the workpiece in which the workpiece is to be coated is set to zero, by means of a control unit. Afterwards the workpiece is sprayed with coating powder in the area to be coated using a powder spray gun.

10 Claims, 5 Drawing Sheets

METHOD AND DEVICE FOR ELECTROSTATIC COATING OF AN ELECTRICALLY CONDUCTING WORKPIECE WITH COATING POWDER

RELATED APPLICATION

The present application claims priority under 35 U.S.C. §119 to European Patent Application No. 07 405 310.9, filed on Oct. 17, 2007, the entire disclosure of which is incorporated herein by reference.

TECHNICAL FIELD

The invention concerns a method and a device for electrostatic coating of an electrically conducting workpiece with coating powder.

During electrostatic surface coating, coating powder is sprayed from a spray gun onto the surface of a workpiece. The electrical field forces are used in this application to electrically charge the powder particles and to strengthen the movement of the powder particles towards the workpiece.

The corona coating is a special form of electrostatic surface coating. An electrode located in the spray gun has a high DC voltage applied to it and the workpiece is earthed. This produces an electrical field between the electrode tips and the workpiece. When the electrical potential gradient between the electrode tips and the workpiece exceeds a specific value, but is still not high enough to produce a spark discharge, then a corona discharge or in short corona occurs. In this method the fluid (air molecules, powder particles), which surrounds the electrode tip, is ionised and thus electrically charged. The corona discharge is a method wherein a (permanent) flow of current is generated from the electrode through the air and the powder towards the workpiece. The charge carriers are ions which are generated by a plasma existing around the electrode tip.

The electrical field which exists between the electrode tip and the workpiece causes an electrical force to operate on the charged particles, also known as the Coulomb force. This force acting on the charged particle is proportional to the field strength and increases in strength as the charge strength increases.

The polarity of the pointed electrode determines the polarity of the corona. If a negative potential is applied to the electrode then electrons are emitted from the electrode which ionise air molecules or powder particles they meet.

DISCUSSION OF RELATED ART

The majority of powder types can be better charged negatively than can be charged positively. This is why a negative high voltage is applied to the electrodes of a spray gun for the majority of coating plant. Where and how the powder is now deposited in detail depends on a number of factors including the strength of the voltage, the strength of the current from a corona discharge, the polarity, the kinetic energy of the powder particles, the amount of air used for the dilute phase pneumatic conveying, the distance to the workpiece and the geometry of the workpiece.

If one operates for corona coating with round jet nozzles with round deflector balls or deflector plates then these steer the powder stream around to the side and distribute the powder over a large area. In this way the speed of the powder particles is reduced considerably and the kinetic energy of the powder particles is reduced. The pull on the electrically charged powder particles to the earthed workpiece now exceeds the kinetic energy produced by the spray conveying. The powder particles now move along the electrical field lines between the electrode and the workpiece and are finally deposited on the workpiece. An even depositing of the powder on the workpiece is achieved in this way but the method leads to increased depositing of the powder at the edges of the workpiece because the electrical field lines concentrate at the edges of the workpiece. This undesirable effect is known in the branch as the "picture frame effect".

Depressions in workpieces create Faraday cages which lead to the situation whereby the electrical field lines cannot penetrate into them. This effect also means, however, that no powder or little powder can find its way into depressions in the workpiece.

If a flat jet nozzle is used instead of a round jet nozzle, the above-mentioned problems can be reduced somewhat, but not completely removed. The powder particles are brought up to a high speed by the flat jet nozzle and blown directly onto the workpiece with a high kinetic energy. In this way the Faraday cages can be partially penetrated by powder particles. Also the build-up at the edges, that is increased powder depositing and an increased layer thickness in the area of the edges, is reduced by the high kinetic energy. However, homogenous distribution of the powder particles over the workpiece is unfortunately worse for flat jet nozzles.

A better and more homogenous powder layer is obtained if one reduces the amount of air used for the dilute phase pneumatic conveying of powder particles. However, this also leads to a reduction in the kinetic energy of the powder particles and to a greater influence of electrical field forces on the powder particles. This leads to the problems such as build-up at the edges and poor penetration into Faraday cages mentioned above.

FIG. 1 shows the field line distribution for a corona coating method, whereby the spray gun 10 is standing close to the edge of the workpiece. The field lines run from the electrode tip 2 of the powder spray gun 10 to the earthed workpiece 1. The fact that workpiece 1 is a three-dimensional object means that there are three-dimensional equi-potential surfaces on which the respective potential is constant. However, in FIG. 1 only the equi-potential lines are shown for a better understanding, that is each of the lines on which the electrical potential is constant. They run perpendicularly to the field lines. The field lines are perpendicular to the workpiece surface in the middle range of workpiece 1 and are evenly distributed over the workpiece surface. However, the field lines run crowded together at the edges of workpiece 1. Therefore more powder is deposited in this area. This leads to a build-up at the edges. Some of the field lines even pass over the rear side of workpiece 1. Therefore some of the powder is deposited there.

From the relevant art M. Cudazzo, U. Strohbeck "Pulverlackieren von Kunststoff—kommt der Durchbruch?", Carl Hanser Verlag, München, MO Volume. 54 (2000) 6, page 50-51, a method is known for electrostatic coating of an electrically non-conducting workpiece with coating powder. In order to coat the workpiece, which is made for example of plastic, the workpiece is sprayed on the one side with positively charged powder particles from a spray gun and on the other side with negatively charged powder particles from another spray gun. The differently charged particles pull on each other. The workpiece located in-between is bombarded on both sides at the same time by positively and negatively charged particles. Charge balancing compared to the earth potential is prevented by the electrically non-conducting property of the workpiece. Charge balancing occurs instead through the workpiece with two oppositely charged particles.

The fact that the workpiece is electrically non-conducting means that the electrical field required for electrostatic powder coating between the spraying device and the workpiece cannot be created. The particle charges must be able to generate image charges at the workpiece surface so that Coulomb forces can arise between the powder particles and the workpiece surface. This in turn requires that the workpiece surface is electrically conducting and earthed. The electrically non-conducting workpiece surface cannot, however, be earthed and the charge cannot be channeled off defined to the earth potential. Thus no Coulomb forces can act between the powder particles and the workpiece surface. This method is therefore specially designed for electrically non-conducting workpieces.

SUMMARY OF THE INVENTION

An object of the invention is, therefore, to specify a method and a device for electrostatic coating of an electrically conducting workpiece with coating powder for which an even, homogenous layer thickness is achieved, both in the planar area of the workpiece and in the area of the workpiece edges.

The object of the invention is fulfilled by a method for electrostatic coating of an electrically conducting workpiece with coating powder.

The method according to the invention for electrostatic coating of an electrically conducting workpiece with coating powder includes the following steps. The workpiece is earthed. Then a negative potential is applied to an electrode, whereby the negative potential is negative compared to that of the workpiece. Furthermore, a positive potential is applied to a counter-electrode, whereby the positive potential is positive compared to that of the workpiece. Then the potential in the area of the workpiece in which the workpiece is to be coated is adjusted by means of a control unit depending on the powder layer thickness desired in this area and the workpiece is then sprayed with coating powder in this area by means of a powder spray gun.

The object of the invention is also fulfilled by a device for electrostatic coating of an electrically conducting workpiece with coating powder.

The device according to the invention for electrostatic coating of an electrically conducting workpiece with coating powder includes a powder spray gun with an electrode. There is also a counter-electrode and a control unit provided to adjust the potential for the electrode and for the counter-electrode. The control unit is designed and can be operated in such a way that the location of the zero-potential is adjustable.

Advantageous developments on the invention can arise from the features described in the dependent claims.

The area to be coated can be at the border of the workpiece and, in particular, on an edge of the workpiece or an opening in the workpiece.

In one further development of the method according to the invention the potential at the electrode is adjusted appropriately to adjust the potential in the area of the workpiece to be coated.

In another further development of the method according to the invention the potential at the counter-electrode is adjusted appropriately to adjust the potential in the area of the workpiece to be coated.

For the method according to the invention it is possible to arrange that the potential in the area of the workpiece to be coated is adjusted by appropriately adjusting the position of the counter-electrode.

It is advantageously possible to adjust the potential in the area of the workpiece to be coated in such a way that it is almost zero there.

In one embodiment of the method according to the invention the counter-electrode moves synchronously with the electrode.

In another embodiment of the method according to the invention, the flowing current from a corona discharge generated by the electrode is maintained at a constant value.

It is advantageously possible with the method according to the invention to have the current from a corona discharge flowing through the counter-electrode adjusted to be made dependent on the strength of the current from a corona discharge flowing through the electrode. In this way it is possible to adjust the current flowing away over the workpiece. This is significant for a number of reasons including the operating safety.

In order to fulfil the object it is further suggested that the current from a corona discharge flowing through the counter-electrode or the potential applied to the counter-electrode is increased and/or the distance of the counter-electrode to the workpiece is decreased if the powder layer thickness on the workpiece should be reduced.

If the powder layer thickness on the workpiece should, on the other hand, be increased then it is possible to do this by reducing the current from a corona discharge flowing through the counter-electrode or the potential applied to the counter-electrode and/or increasing the distance of the counter-electrode to the workpiece.

For the method according to the invention it is possible to arrange that a further counter-electrode has a further positive potential applied to it compared to that of the workpiece. The electrical field can be adapted even more in this way to the geometry of the workpiece.

For the device according to the invention it is possible for the control unit to have an operating element provided to specify the desired powder layer thickness. In this way the user can specify how thick individual areas of the workpiece should be coated with powder.

Furthermore, for the device according to the invention it is possible to arrange for the position of the counter-electrode to be adjustable. The electrical field can be adapted even more in this way to the geometry of the workpiece.

As a final embodiment of the device according to the invention the counter-electrode can be located on the same side as the powder spray gun.

BRIEF DESCRIPTION OF THE DRAWINGS

The invention with its numerous embodiments is explained in the following on the basis of five figures.

FIGS. 6*a* to 6*f* show various edges, borders and openings in the workpiece in a view from above.

DETAILED DESCRIPTION OF THE INVENTION

Figure 1:
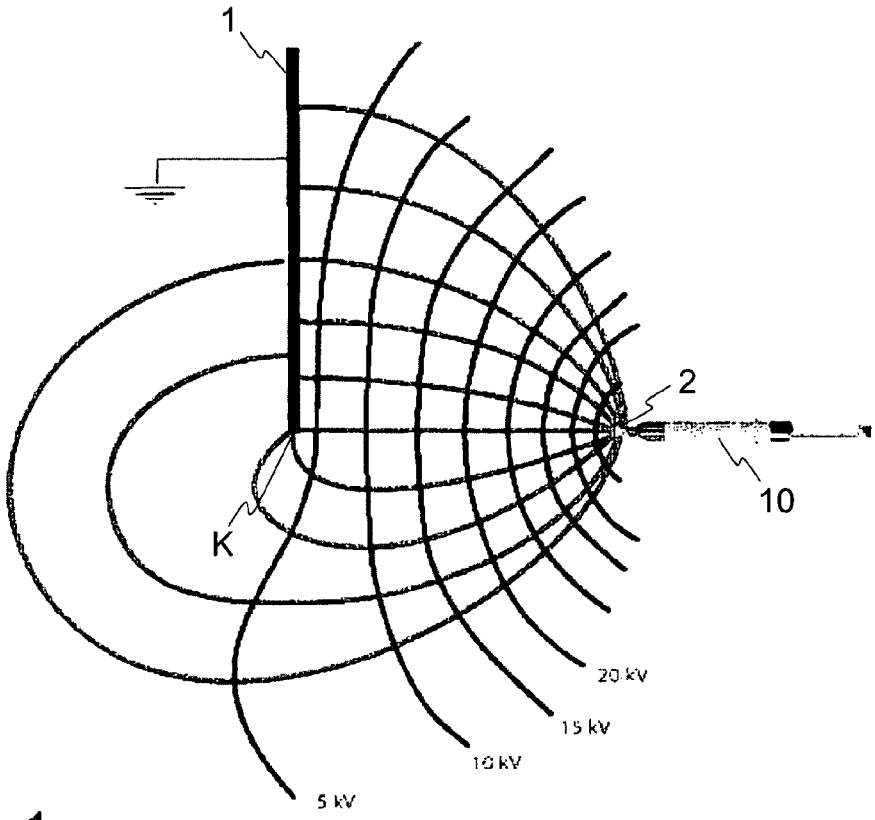
FIG. 1 shows a conventional scheme for powder coating.
Figure 2A:
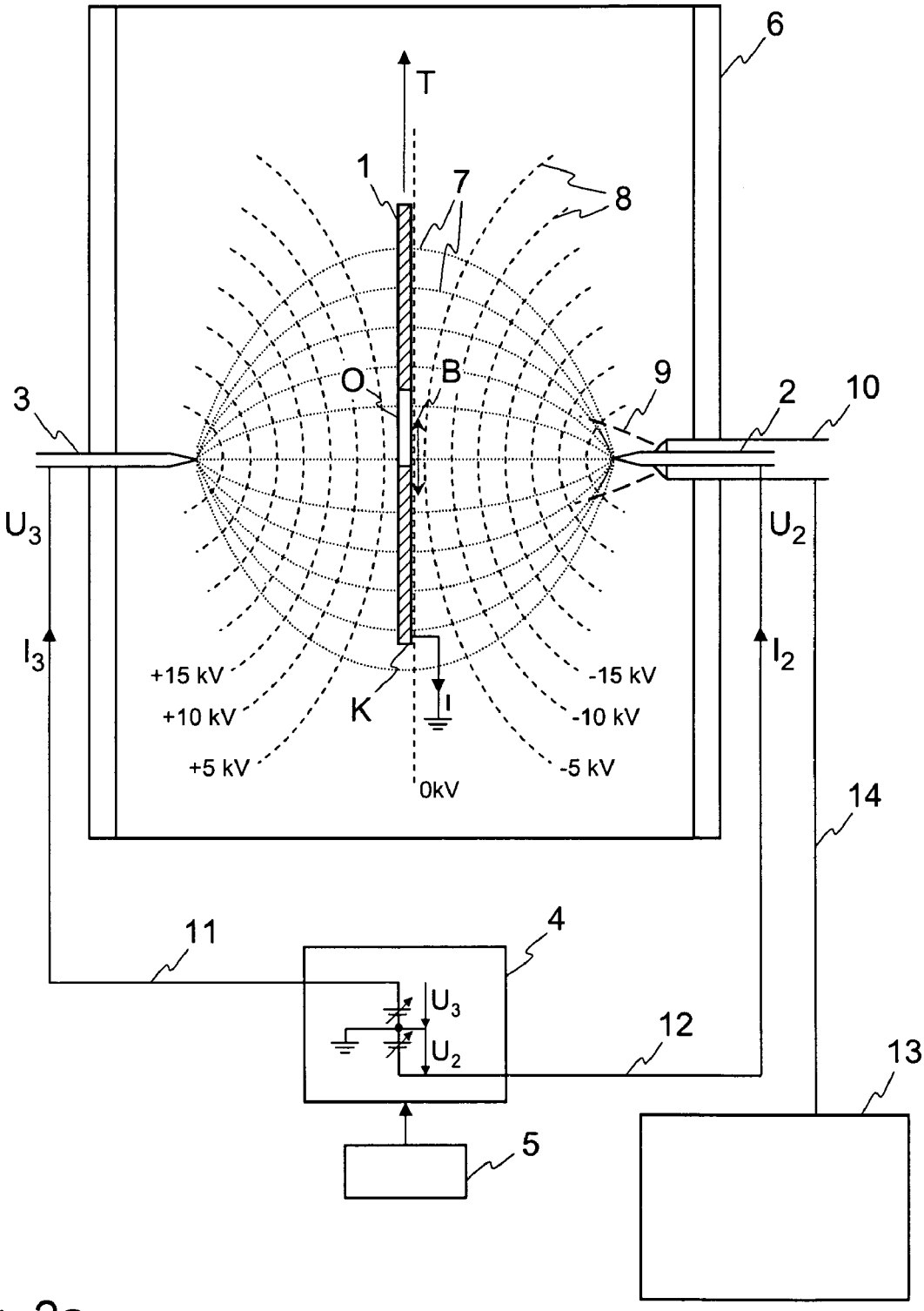
FIG. 2*a* shows a first possible embodiment of the scheme according to the invention for powder coating during coating of an opening in a workpiece.

In FIG. 2*a* a first possible embodiment of the scheme according to the invention for powder coating is shown in a view from above. A flat workpiece 1 with an opening O, which can be located at any location in workpiece 1, is moved for coating purposes in the transport direction T through a powder coating cabin 6. A powder spray gun 10, which is provided with an electrode 2, projects through a side wall of the cabin 6. The electrode 2 is also called spray electrode. The side of workpiece 1, which will be coated with the powder spray gun 10, is called the front side. A counter-electrode 3 is located on the opposite side wall of the cabin 6. The counter-electrode 3 can be part of a further powder spray gun, but this is not shown in FIG. 1.

A high DC voltage $U_2$, for example −30 kV, is applied to the electrode 2 during the coating method. There is also a high DC voltage $U_3$ applied to the counter-electrode 3, which is located behind the workpiece 1, that does, however, have an opposite polarity to the voltage $U_2$. The voltage $U_2$ can be of +37 kV, for example. In this way an electrostatic field is created between the spray gun 10 and the counter-electrode 3. The field lines 7 are shown dotted and the equi-potential lines 8 dashed. The equi-potential line is not curved in the geometrical middle between the electrode 2 and the counter-electrode 3 if both voltages $U_2$ and $U_3$ are set appropriately. In an ideal case this applies in all three dimensions even if it is only drawn on paper just in two dimensions for simplicity. The electrode 2 and the counter-electrode 3 generate the same electrical fields but with an opposing polarity with reference to the reference earth. The middle area is therefore located at the potential zero. This means that the same potential is present there as that of the earth.

The electrical field shown in FIG. 2*a* is not influenced by a flat, earthed workpiece 1. The powder cloud 9 generated by the spray gun 10 meets the workpiece 1 in area B, which is designated as the coating zone. The powder particles move in the coating zone B along the field lines during coating of the workpiece and thus meet in this zone B perpendicularly to the workpiece surface. In this way a constant powder layer thickness is achieved on the workpiece.

Figure 2B:
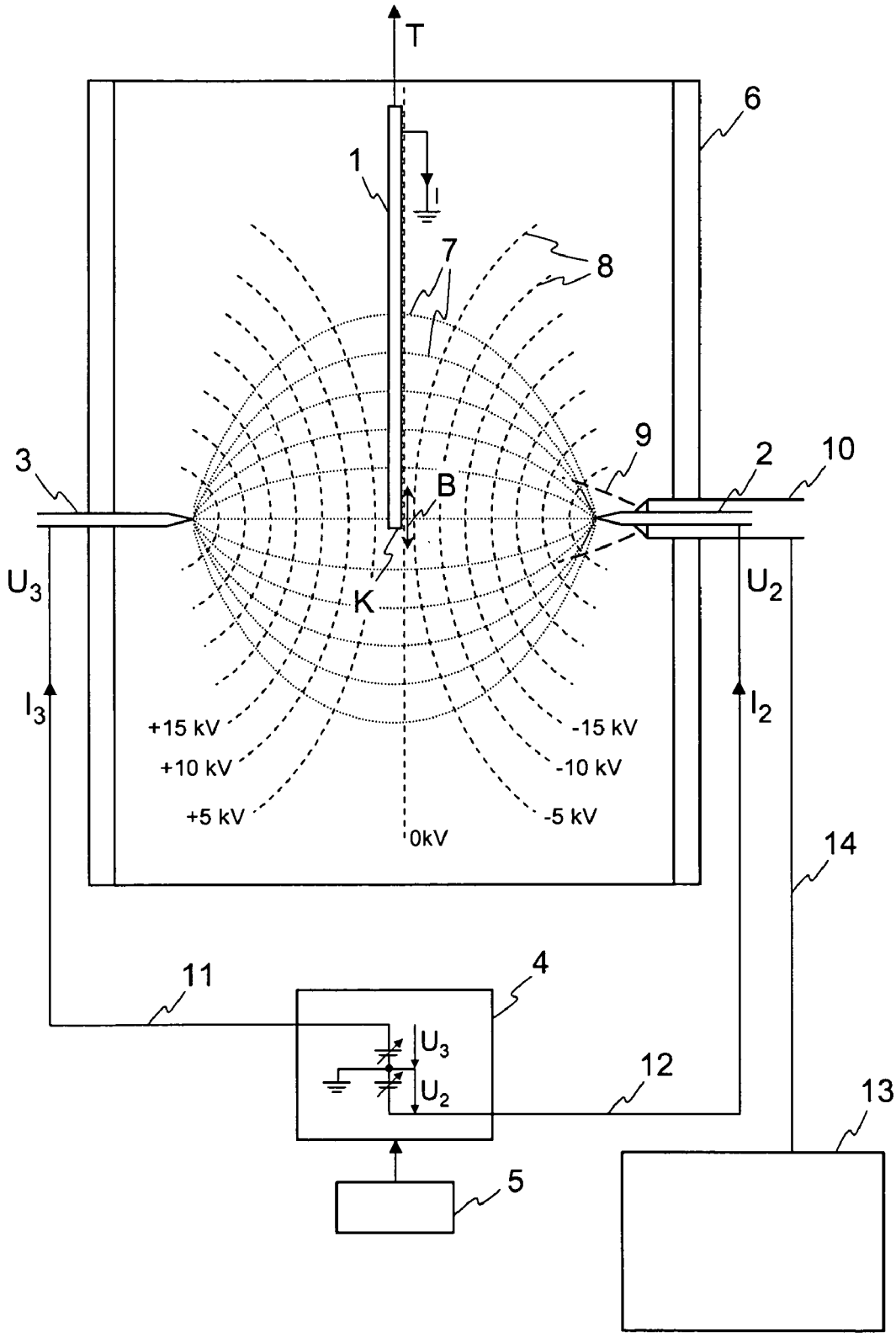
FIG. 2*b* shows the first embodiment of the scheme according to the invention for powder coating during coating of an edge on a workpiece.

During the coating method the workpiece 1 is moved further so that the edge K of workpiece 1 is located in the coating zone B after a specific period of time. Workpiece 1 is now located partially in the electrical field. This is shown in FIG. 2*b*. The electrical field is not significantly influenced by the position of the workpiece 1. The powder particles sprayed from the powder spray gun 10 therefore follow the course of the field lines, as before, in the coating zone B. Since the field lines are not deformed in the area of the edge K, there is no wrap-around of the field lines on the rear side of the workpiece 1 (in contrast to the course of the field lines in FIG. 1) and also no increased field strength occurs on the edge K so the powder depositing in the area of the edge K will neither increase nor decrease. Thus a constant powder layer thickness will be achieved, also in the area of the edge K, and a build-up at the edges is avoided. The same also applies essentially for a rounded workpiece border R, as shown in FIG. 6*d*.

Controlling of powder depositing at the edge K or generally at the border of the workpiece A change in the voltage $U_3$ at the counter-electrode 3 can change the course of the electrical field lines and therefore also the position of the equi-potential line, on which the potential zero lies, can be moved relative to workpiece 1. If the high voltage $U_3$ at the counter-electrode 3 is increased then the equi-potential line with the potential zero wanders in the direction of powder spray gun 10. In this way the field lines of counter-electrode 3 reach up to the front side of workpiece 1. This in turn leads to the situation whereby less powder is deposited in the area of edge K. If the high voltage $U_3$, which is also designated as the counter-voltage, is reduced, the field lines of the spray gun 10 pass beyond edge area onto the rear side of workpiece 1. Thus more powder is deposited in the area of edge K.

Therefore targeted alteration of the electrical parameter can be used to control where and how much powder is deposited on the workpiece.

For conventional electrostatic coating with just one, for example, negatively charged electrode 2, the negative charge carriers or electrons move from the negative spray electrode 2 through the air to the earthed workpiece 1 and from there out over the workpiece suspension or workpiece fastening over the earth back to the high voltage generator. Thus the current circuit is completed. If this current circuit is interrupted (broken) there will be a high voltage difference at the point of interruption. If, for example, workpiece 1 is suspended on an electrically non-conducting or poorly conducting hook, then workpiece 1 can be charged to a voltage of 10 kV and more. The reason for the poor electrical conductivity can be paint residues on the hook. The result is poor coating of the workpiece. Because of the poor electrical conductivity of the hook and therefore poor earthing (grounding), the corona current cannot flow to earth, the workpiece gets charged with electricity, electrical discharges can occur and sparks, which can cause ignition, can occur. In the device according to the invention two independent opposite poled current circuits operate on the same workpiece 1. These current circuits are ideally the same in size. If current $I_2$, which flows through electrode 2 of the coating gun 10 to workpiece 1, is −50 μA, for example, then current $I_3$, which flows through the counter-electrode 3 to workpiece 1, is +50 μA. The sum of currents $I_2$ and $I_3$ in workpiece 1 is zero according to the First Kirchhoff Circuit law. 50 μA flows from electrode 2 of the spray gun 10 over the air to workpiece 1 and from there over the air to counter-electrode 3. Thus no current flows over the workpiece suspension to earth. Current I in the workpiece suspension is therefore zero. This means that also electrically poorly conducting components can be coated electrostatically. Workpiece 1 is still earthed, however, like before, on safety grounds.

The potentials $U_2$ and $U_3$ are set by means of a control unit 4 and also regulated if necessary. Control unit 4 is connected for this purpose via an electrical line 11 with the counter-electrode 3 and via an electrical line 12 with the electrode 2. The control unit 4 is provided with an operating element 5 to set the desired layer thickness. The operating element 5 can, for example, be a rotary knob, a button or a keyboard. Apart from the potentials $U_2$ and $U_3$, control unit 4 can also monitor and regulate currents $I_2$ and $I_3$.

The spray gun 10 is connected via a powder hose 14 with a powder reservoir 13 to supply the spray gun 10 with powder.

Figure 3:
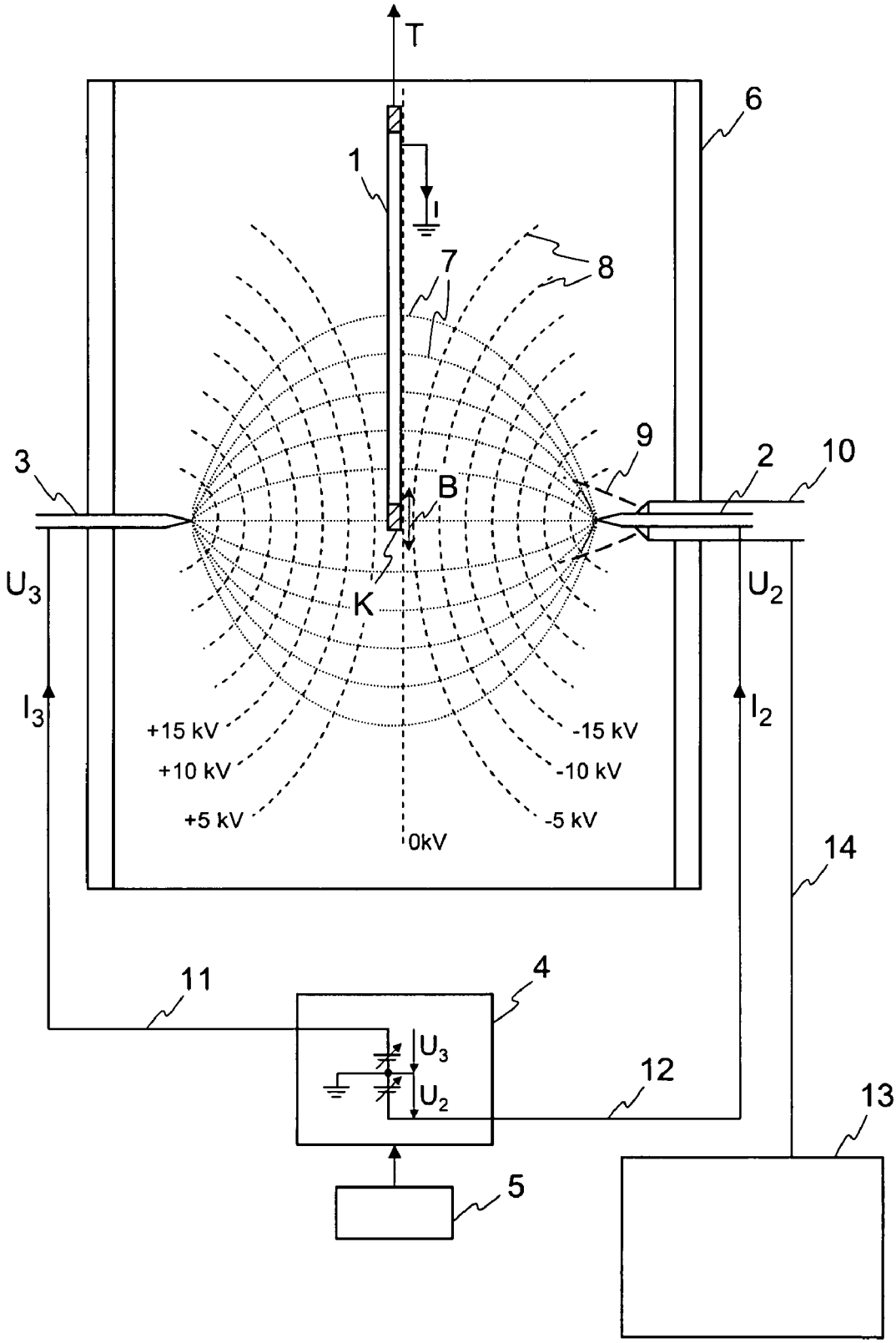
FIG. 3 shows the first embodiment of the scheme according to the invention for powder coating during coating of a frame-shaped workpiece.

FIG. 3 shows the first embodiment of the scheme according to the invention for powder coating during coating of the frame shaped workpiece 1. The fact that the electrical field will also not be significantly effected by the frame shaped workpiece 1 means that the sprayed powder particles from powder spray gun 10 in the coating zone B follow the course of the field lines as before and meet there perpendicular to the frame so that powder deposit there neither increases nor decreases. Thus a constant powder layer thickness is also achieved for a frame shaped workpiece and build-up at the edges is avoided.

Figure 4:
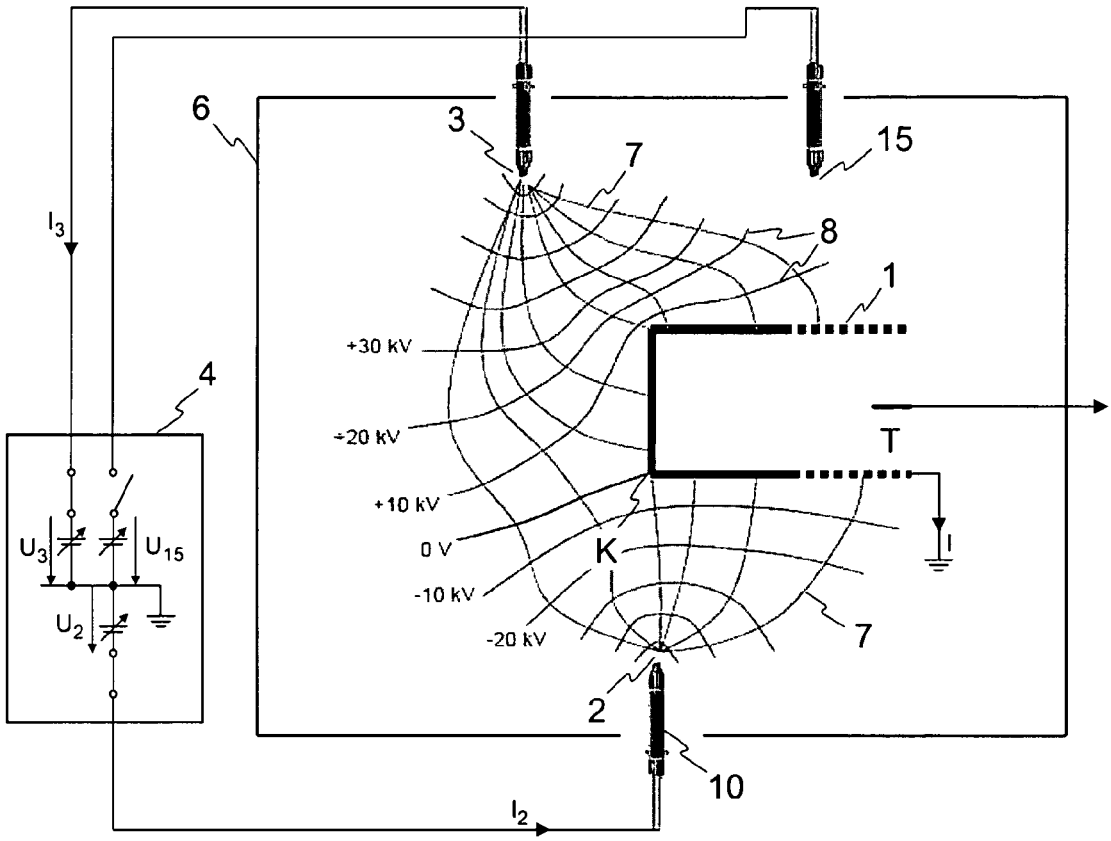
FIG. 4 shows a second possible embodiment of the scheme according to the invention for powder coating during coating of the workpiece edge.

FIG. 4 shows a second possible embodiment of the scheme according to the invention for powder coating during coating of the workpiece edge K. The workpiece is now not a thin part anymore but demonstrates a significant depth as shown in FIG. 4. The powder spray gun 10 with spray electrode 2 is located on one side of the cabin 6 as found in the embodiment described in FIGS. 2*a* and 2*b*. There are now two counter-electrodes 3 and 15 on the opposite side of cabin 6. Both can respectively be part of a further spray gun. The counter-electrode 15 no longer has voltage applied to it. It creates the electrical field between the electrode 2 and the counter-electrode 3 shown in FIG. 4. The equi-potential line with the potential zero runs through the edge K to be coated. The potential $U_3$ at the counter-electrode 3 is selected to be higher than the potential $U_2$ at the electrode 2 of the coating gun 10 to achieve this.

Workpiece 1 is moved in the direction T out of the coating area. Thus the rear surface of the workpiece is coated. The left counter-electrode 3 is active to ensure that the rear edge K is not coated too thickly. If the workpiece 1 were transported into the coating area instead, then the right counter-electrode 15 would be active.

Figure 5:
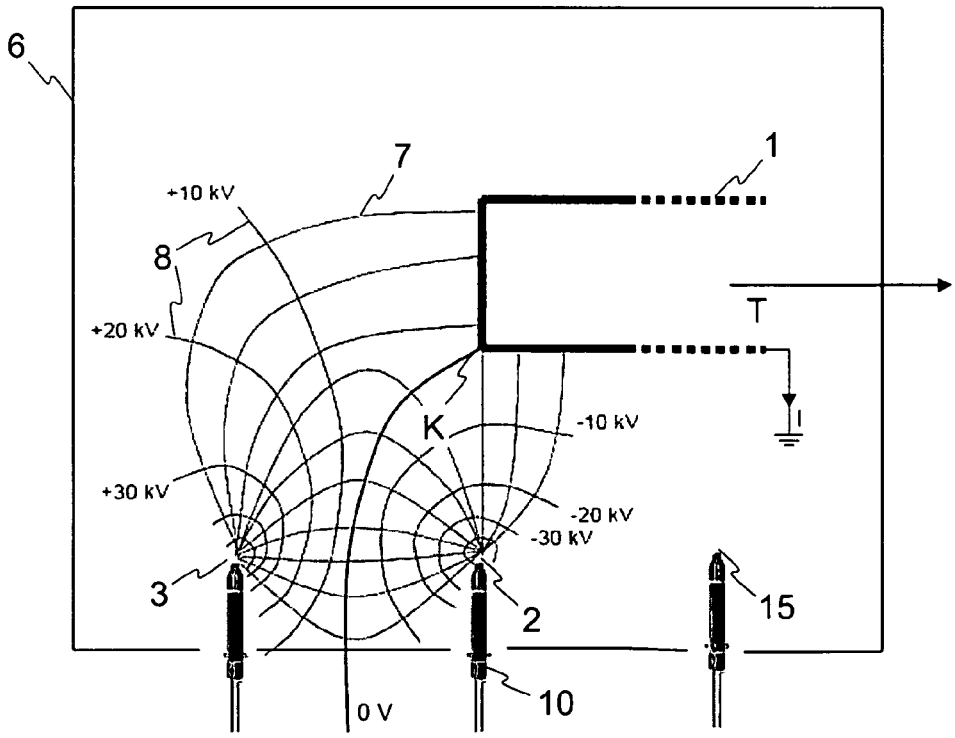
FIG. 5 shows a third possible embodiment of the scheme according to the invention for powder coating during coating of the workpiece edge.

FIG. 5 shows a third possible embodiment of the scheme according to the invention for powder coating during coating of the workpiece edge. Both the spray gun 10 and both counter-electrodes 3 and 15 are located on one side of the cabin 6 in this embodiment. The counter-electrodes 3 and 15 can respectively be part of a further spray gun. The counter-electrode 15 no longer has voltage applied to it. It creates the electrical field between the electrode 2 and the counter-electrode 3 shown in FIG. 5. The equi-potential line with the potential zero runs through the edge K to be coated.

Workpiece 1 is moved in the direction T out of the coating area and the rear surface of the workpiece 1 is coated. If the workpiece 1 were transported into the coating area instead, then the right counter-electrode 15 would be active.

In order not to have to provide two counter-electrodes 3 and 15, just one counter-electrode 3 can be provided which is movable. Thus counter-electrode 3 can, for example, be swiveled from the position on the left of the spray gun 10 to the position on the right of the spray gun 10.

Flat plate, flat profiled parts and very thin parts can also be coated by means of the method according to the invention and of the device according to the invention without any of the usual accumulation of powder at the edges, at holes or at other recesses. The picture frame effect is effectively avoided. Also the powder depositing at the edges can be controlled.

The workpiece including its edges can be coated with an even thickness of powder using the above-mentioned measures. However more or less powder can be applied at the edges if so desired. It is therefore also possible to avoid powder coating at the edges altogether. One can also achieve homogenous distribution of the powder depositing on the flat areas of the workpiece using the method according to the invention.

One further effect of this method is that the leakage current I in the workpiece is strongly reduced or zero. This leakage current I can be held at zero using automatic or manual regulation. This means that also workpieces with a poor or low electrical conductivity can be coated. This can be advantageous for coating MDF plates.

The term counter-electrode should express the fact that the potential at this counter-electrode is opposite to that at the electrode.

Figure 6A:
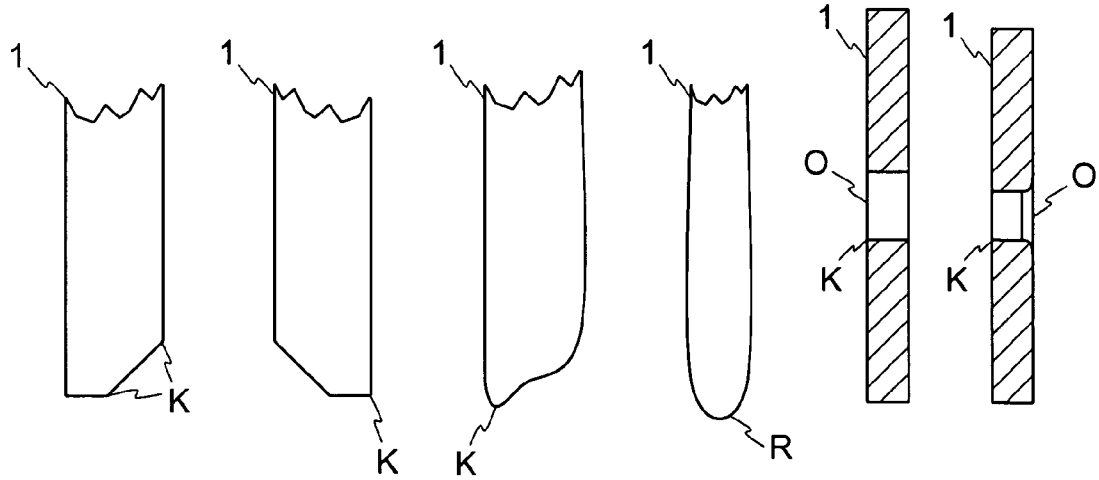

FIGS. 6*a* to 6*f* show various edges K, borders R and openings O in workpiece 1 viewed from above. The term border R refers to a delimitation of the workpiece 1 which can be formed in any way one wishes. Thus the workpiece edges K in FIGS. 6*a*, 6*b* and 6*c* also come under the umbrella term workpiece border. Also the openings O in the workpiece in FIGS. 6*e* and 6*f* are workpiece borders. The right border of the opening O in FIG. 6*f* is less curved than the right border of the opening O in FIG. 6*e*.

The preceding description of the embodiments according to the present invention is used only for illustrative purposes and not for the purpose of restricting the invention. Different alterations and modifications are possible within the framework of the invention without leaving the scope of the invention and its equivalents.

LIST OF REFERENCE SIGNS

1 Workpiece
2 Electrode
3 Counter-electrode
4 Control unit
5 Operating element
6 Cabin or booth
7 Field lines
8 Equi-potential lines
9 Powder cloud
10 Powder spray gun
11 Electrical line
12 Electrical line
13 Powder reservoir
14 Powder hose
15 Further counter-electrode
U2 Potential at electrode 2
U3 Potential at counter-electrode 3
U15 Potential at counter-electrode 15
I2 Current in electrode 2
I3 Current in counter-electrode 3
I Leakage current
T Transport direction
B Coating area
K Workpiece edge
R Workpiece border
O Opening in the workpiece

The invention claimed is:

1. A method for electrostatic coating of an electrically conducting workpiece with coating powder, wherein the workpiece is earthed, wherein a potential, which is negative compared to that of the workpiece, is applied to an electrode, wherein a potential, which is positive compared to that of the workpiece, is applied to a counter-electrode, wherein the potential in an area of the workpiece in which the workpiece is to be coated is set, depending on the desired powder layer thickness in said area, by means of a control unit which controls the potentials respectively applied to the electrode and counter-electrode, wherein the workpiece is sprayed with coating powder in said area to be coated by means of a powder spray gun carrying the electrode, the electrode and counter-electrode serving to create an electrostatic field between the powder spray gun and the counter-electrode, and the workpiece being sprayed with the coating powder within the electrostatic field, and wherein the counter-electrode is moved synchronously with the electrode.

2. The method according to claim 1, wherein the area is an edge of the workpiece, a border of the workpiece or an opening in the workpiece.

3. The method according to claim 1, wherein the potential at the electrode is set to provide a predetermined potential in the area of the workpiece.

4. The method according to claim 1, wherein the potential at the counter-electrode is set to provide a predetermined potential in the area of the workpiece.

5. The method according to claim 1, wherein the position of the counter-electrode is set to provide a predetermined potential in area of the workpiece.

6. The method according to claim 1, wherein the potential in the area to be coated of the workpiece is set to be zero.

7. The method according to claim 1, wherein the current from a corona discharge flowing through the electrode is maintained at a constant value.

8. The method according to claim 1, wherein the current from a corona discharge flowing through the counter-electrode is set to be dependent on the strength of the current from a corona discharge flowing through the electrode.

9. The method according to claim 1, wherein the current from a corona discharge flowing through the counter-electrode is increased to reduce the powder layer thickness on the workpiece.

10. The method according to claim 1, wherein a further potential which is positive compared to that of the workpiece is applied by the control unit to a further counter-electrode for purposes of creating the electrostatic field.

* * * * *